United States Patent [19]

Amboss et al.

[11] Patent Number: 4,942,336

[45] Date of Patent: Jul. 17, 1990

[54] TRAVELING-WAVE TUBE WITH CONFINED-FLOW PERIODIC PERMANENT MAGNET FOCUSING

[76] Inventors: Kurt Amboss, 751 Haverford Ave., Pacific Palisades, Calif. 90272; Jon A. Davis, 6842 Verde Ridge Rd., Rancho Palos Verdes, Calif. 90274

[21] Appl. No.: 182,632

[22] Filed: Apr. 18, 1988

[51] Int. Cl.[5] ..... H01J 25/42

[52] U.S. Cl. ..... 315/3.5; 315/5.35

[58] Field of Search ..... 315/3.5, 5.34, 5.35, 315/5.29, 39.71; 335/210, 306

[56] References Cited

U.S. PATENT DOCUMENTS

| | | | |
|---|---|---|---|
| Re. 31,996 | 10/1985 | Sato | 315/5.35 X |
| 2,812,470 | 11/1957 | Cook et al. | 315/5.35 X |
| 2,828,434 | 3/1958 | Klein et al. | 315/3.5 X |
| 3,027,484 | 3/1962 | Misugi et al. | 315/3.5 |
| 3,324,339 | 6/1967 | Winslow et al. | 315/5.35 X |
| 3,355,622 | 11/1967 | Bradford | 315/3.5 |
| 4,399,389 | 8/1983 | Fleurg et al. | 315/3.5 |
| 4,404,494 | 9/1983 | Heynisch | 315/5.35 X |
| 4,737,680 | 4/1988 | True et al. | 315/3.5 X |
| 4,746,833 | 5/1988 | King et al. | 315/5.35 X |
| 4,820,955 | 4/1989 | Boehme et al. | 315/5.35 X |

FOREIGN PATENT DOCUMENTS

| | | | |
|---|---|---|---|
| 506918 | 5/1976 | U.S.S.R. | 315/5.35 |

OTHER PUBLICATIONS

Reginald D. Perkins, "Practical Theory and Operation of Traveling Wave Tubes and Microwave Glossary", R & L Technical Publishers, San Jose, CA, FIG. 35, p. 46, May 1977.

J. R. Legarra et al., "A Convergent Confined-Flow Focusing System for Millimeter Wave Tubes", Technical Digest IEDM, 1983, pp. 137–140.

W. R. Ayers et al., "RF Beam Spread in PPM Confined-Flow TWT's", Technical Digest IEDM, 1985, pp. 357–360.

Jon A. Davis, "PPMODD PPMEVEN and STICKUP Computer Programs for Finite Length PPM Stacks with Magnets Sticking up Beyond the Pole Pieces", Hughes Aircraft Company, Electron Dynamics Division, Technical Report No. 100, Feb. 1985.

*Primary Examiner*—Eugene R. Laroche
*Assistant Examiner*—Benny T. Lee
*Attorney, Agent, or Firm*—Terje Gudmestad; Paul M. Coble; Wanda K. Denson-Low

[57] ABSTRACT

A traveling-wave tube (10) has a confined-flow periodic permanent magnet focusing arrangement (26) in which either the first magnet (**60*f*) or the third magnet (60*t*) from the electron gun (12) has an extent or axial thickness along the electron stream path which is one-half that of the remaining magnets in the arrangement, thereby providing a scalar magnetic potential of essentially zero on the electron gun pole piece (46), thereby eliminating the field reversal at the cathode (14). This enables a magnetic field to be provided in the region of the electron gun between the gun pole piece (46) and a location behind the cathode due solely to the magnetic field leaking through the gun pole piece aperture (50). The axial magnetic field within the electron gun (12) may be tailored or fine tuned, by varying the size of the aperture (50) in the gun pole piece (46**).

18 Claims, 5 Drawing Sheets

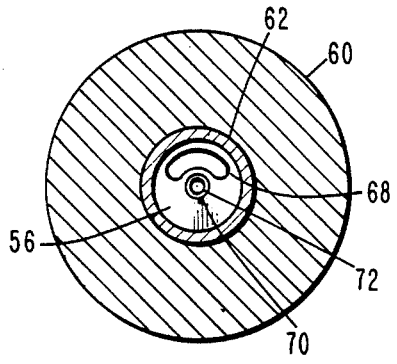
Fig. 2.
Fig. 5.
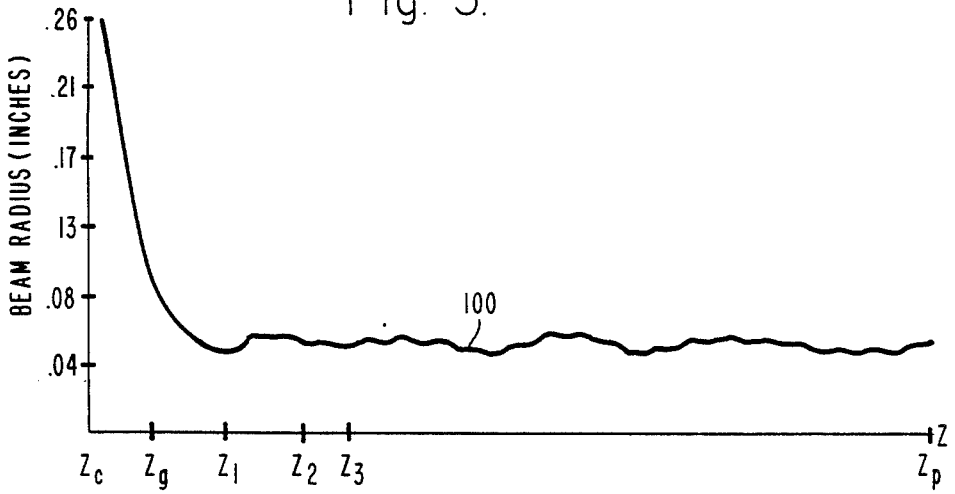

Fig. 3a.
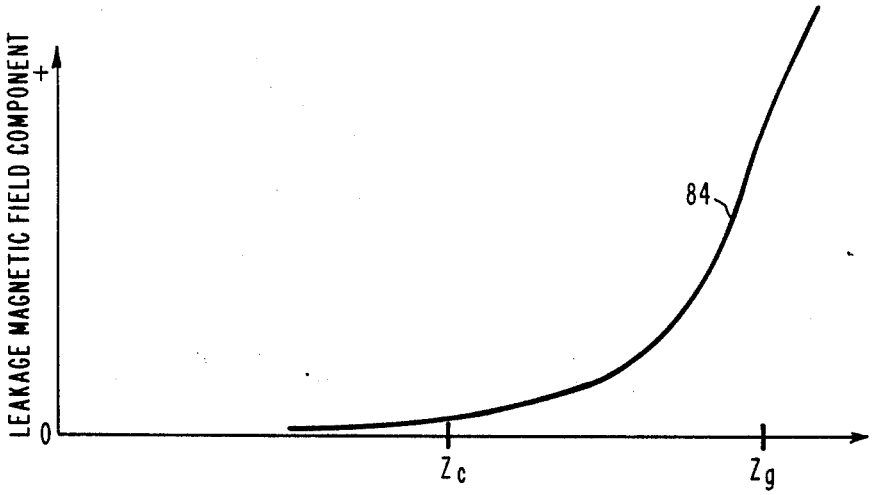
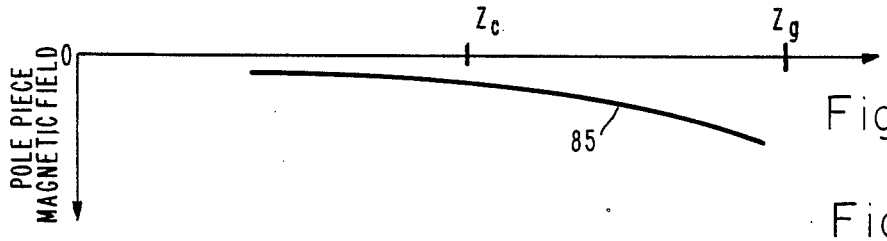
Fig. 3b.
Fig. 3c.
(PRIOR ART)
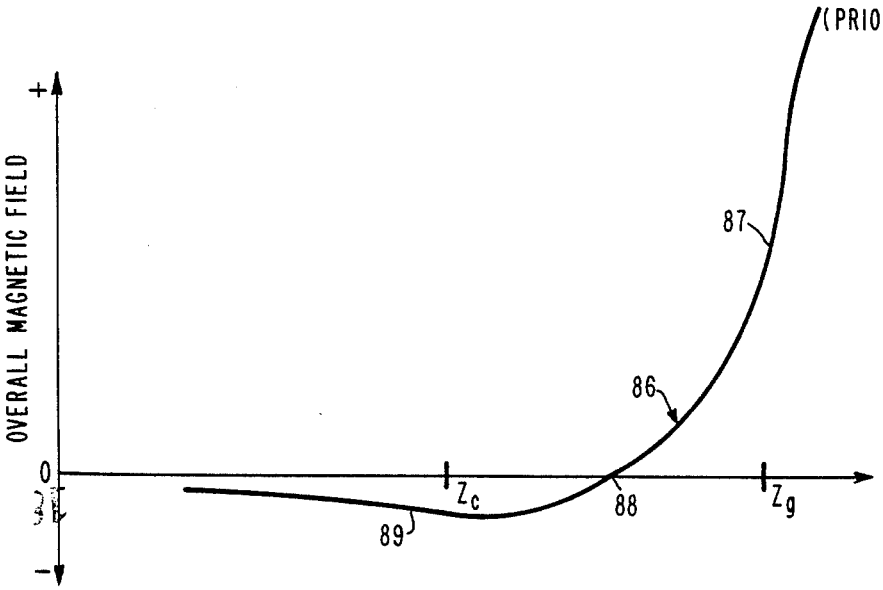

TRAVELING-WAVE TUBE WITH CONFINED-FLOW PERIODIC PERMANENT MAGNET FOCUSING

This invention was made with Government support under Contract DAAL01-86-C-0045 awarded by the Department of the Army. The Government has certain rights in this invention.

TECHNICAL FIELD

This invention relates to traveling-wave tubes, and more particularly relates to a periodic permanent magnet focusing arrangement for providing a confined-flow focusing magnetic field to the cathode region.

BACKGROUND OF THE INVENTION

In traveling-wave tubes a stream of electrons is caused to interact with a propagating electromagnetic wave in a manner which amplifies the electromagnetic energy. In order to achieve such interaction, the electromagnetic wave is propagated along a slow-wave structure, such as a conductive helix wound about the path of the electron stream or a folded waveguide type of structure in which a waveguide is effectively wound back and forth across the path of the electrons. The slow-wave structure provides a path of propagation for the electromagnetic wave which is considerably longer than the axial length of the structure, and hence, the traveling wave may be made to effectively propagate at nearly the velocity of the electron stream. Interaction between the electrons in the stream and the traveling wave causes velocity modulation and bunching of the electrons in the stream. The net result may then be a transfer of energy from the electron stream to the wave traveling along the slow-wave structure.

Since the electron stream is projected along the axis of the tube proximate to the slow-wave structure, the electron stream must be precisely constrained to its axial path in order to prevent excessive impingement of electrons on the slow-wave structure. Generally, this is accomplished by immersing the electron stream in a strong axial magnetic field which tends to provide the required focusing so that the electron stream may pass as closely as possible to the slow-wave structure without excessive interception of electrons by the slow-wave structure. In one of the early techniques for providing the constraining axial magnetic field, the slow-wave structure is aligned coaxially within a long solenoid wound of a conductor carrying a relatively large electrical current. Another early focusing scheme for traveling-wave tubes involves the use of a single large permanent magnet, of a length substantially equal to that of the slow-wave structure, disposed about the slow-wave structure with a pole piece at each end of the magnet. While solenoids and permanent magnets have been able to provide satisfactory focusing, the excessive size and weight of these focusing arrangements have made tubes focused in this manner impractical for many mobile applications.

In order to provide more compact focusing devices for traveling-wave tubes, periodic permanent magnet focusing arrangements were developed in which a plurality of like short annular permanent magnets are disposed in axial alignment along and about the slow-wave structure with a plurality of annular ferromagnetic pole pieces interposed between and abutting adjacent magnets. The magnets are magnetized axially and arranged with like poles of adjacent magnets confronting one another so that there is produced, along the axis of the tube, a periodic magnetic field of sinusoidal distribution, with zero field occurring at each pole piece and with a period equal to twice the pole piece spacing.

The periodic permanent magnet focusing arrangements are terminated at each end by annular ferromagnetic pole pieces to which the electron gun and the electron collector assemblies, respectively, are attached. A fringing magnetic field extends beyond the gun and collector pole pieces and influences the electron flow, usually in an undesirable manner. It is often deemed advisable to exclude this fringing magnetic field from the electron gun region in order to achieve a condition known as Brillouin flow. This has been done by surrounding the electron gun with a ferromagnetic shield and by keeping the aperture in the gun pole piece, through which the electron stream enters the periodic field region, small.

Confined flow focusing in which the cathode is located in a region of a relatively low, but non-vanishing magnetic field, is frequently used in solenoid focused tubes. Confined-flow focusing requires a larger main magnetic field to focus the electron stream than in the case of Brillouin flow. However, in the stronger magnetic field employed with confined-flow focusing, the electrons are less affected by RF defocusing fields and other perturbing effects; hence, improved beam transmission through the slow-wave structure results.

In solenoid confined-flow focusing arrangements, the desired magnetic field in the vicinity of the cathode is provided by leakage of the solenoid-generated focusing field through the aperture in the gun pole piece. The magnitude of the magnetic field at the cathode may be controlled by controlling the diameter of the gun pole piece aperture and the distance of the cathode from this aperture. A larger aperture extends the distance over which the magnetic field monotonically builds up from a small value at the cathode to the much larger uniform value required in the RF interaction region of the tube. With a properly matched convergent flow electron gun of the Pierce type, the magnetic field adds slightly to the reduction of the electron stream diameter obtained by the electrostatic field alone.

In a conventional periodic permanent magnet focusing arrangement wherein the magnets all have substantially the same axial extent, the axial fringing magnetic field does not decrease monotonically as a function of distance from the gun pole piece in the electron gun region, but rather has a reversal in polarity which generally occurs between the cathode and anode of the gun in a region where the electrons are compressed by the electrostatic field. This reversal in the polarity of the magnetic field gives rise to an outward magnetic force on the electrons and, therefore, reduces the beam convergence produced electrostatically by the gun design in the vicinity of the field reversal. Thus, in the past, it has not been practical to achieve confined-flow focusing with a periodic permanent magnet arrangement.

In a few instances where confined-flow focusing has been used in conjunction with periodic permanent magnet focusing, the confined-flow in cathode region has been achieved by coaxially disposing additional permanent magnets and pole pieces about the electron gun. This type of arrangement is shown in FIG. 35, page 46 of *Practical Theory and Operation of Traveling Wave Tubes and Microwave Glossary*, by Reginald D. Perkins, R&L Technical Publishers, San Jose, Calif., November 1973 (Revised May 1977). Design considerations, as well as both computer simulation and test data for such an arrangement are given in "A Convergent Confined-Flow Focusing System for Millimeter Wave Tubes", by J. R. Legarra et al., *Technical Digest IEDM*, 1983, pages 137–140, and "RF Beam Spread in PPM Confined-Flow TWTs", by W. R. Ayers et al., *Technical Digest IEDM*, 1985, pages 357–360.

When permanent magnets and pole pieces are disposed about the electron gun of a traveling-wave tube, a danger of arcing is present because to be effective the magnets need to be close to the high voltage ceramic portion of the gun and, therefore compromise the breakdown spacing. Moreover, some adjustment of the magnetic field is generally necessary during initial operation of the traveling-wave tube, and magnets in this location present a physical hazard. In addition, stray fields from the larger diameter magnets surrounding the gun make location of the traveling-wave tube more critical with respect to other system components.

Additional background of interest with respect to the present invention are the computer simulations described in Hughes Aircraft Company, Electron Dynamics Division, Technical Report No. 100, "PPMODD, PPMEVEN, and STICKUP. Computer Programs for Finite Length PPM Stacks With Magnets Sticking Up Beyond the Pole Pieces", by Jon A. Davis, February 1985. These computer programs served as analytical models of samarium cobalt periodic permanent magnet stacks without any aperture in the end pole pieces, and they also predicted the magnetic field at the cathode. A conclusion reached was that, by making the magnet next to the gun pole piece half as thick as the others, the magnetic field at the cathode is substantially eliminated in the absence of an aperture in the gun pole piece.

SUMMARY OF THE INVENTION

It is an object of the present invention to provide a traveling-wave tube having a confined-flow periodic permanent magnet focusing arrangement which minimizes any tendency for arcing in the vicinity of the electron gun.

It is a further object of the invention to provide a simple and reliable confined-flow periodic permanent magnet focusing arrangement for a traveling-wave tube in which the magnetic field in the electron gun region can be readily and safely adjusted.

It is still another object of the invention to provide a traveling-wave tube with a confined-flow periodic permanent magnet focusing arrangement in which stray magnetic fields outside of the electron gun region of the tube are substantially reduced.

It is yet another object of the present invention to provide a confined-flow periodic permanent magnet focusing arrangement for a traveling-wave tube which does not degrade the beam convergence of the electron gun.

In a traveling-wave tube according to the invention, an electron gun generates a stream of electrons along a predetermined axial path, and a collector is disposed at the end of the path away from the electron gun to collect stream electrons. A confined-flow periodic permanent magnet focusing arrangement for focusing the stream of electrons includes a first ferromagnetic pole piece disposed along the axial path immediately downstream from the electron gun, a second ferromagnetic pole piece disposed along the path immediately upstream from the collector, and a plurality of intermediate ferromagnetic pole pieces disposed at respective spaced locations along the path between the first and second pole pieces. The first, second and intermediate pole pieces all have respective aligned apertures along the path to provide a passage for the electron stream. A series of permanent magnets is provided, with the magnets respectively interposed between and abutting adjacent pole pieces and with like poles of adjacent magnets confronting one another.

The extent along the axial path of at least selected ones of the magnets is such as to provide a magnetic potential of essentially zero on the first pole piece, thereby precluding an axial magnetic field polarity reversal in the electron gun. In preferred embodiments of the invention this may be achieved by making either the first magnet or the third magnet from the first pole piece with an extent, that is, the axial thickness of the selected magnet, along the axial path approximately one-half that of the remaining magnets in the series. A slow-wave structure is disposed along and about the electron stream path adjacent to at least a portion of the series of magnets for propagating electromagnetic wave energy in such manner that it can interact with the stream of electrons.

With this arrangement of magnets, the axial magnetic field within the electron gun may be tailored, or fine tuned, by varying the size of the aperture in the gun or first pole piece. Specifically, the solenoid confined-flow focusing arrangement discussed above is applied in a novel manner to the periodic permanent magnet (PPM) focusing arrangement of the present invention.

Additional objects, advantages, and characteristic features of the present invention will become readily apparent from the following detailed description of a preferred embodiment of the invention when considered in conjunction with the accompanying drawings.

BRIEF DESCRIPTION OF THE DRAWINGS

In the accompanying drawings:

FIG. 2 is a cross-sectional view taken along line 2—2 of FIG. 1;

FIG. 3*a* is a graph showing the theoretical axial magnetic field component due to magnetic field leakage through the gun pole piece aperture in the electron gun region of a traveling-wave tube constructed with a periodic permanent magnet focusing arrangement having magnets of the same axial extent;

FIG. 3*b* is a graph showing the theoretical axial magnetic field component due to the magnetic potential on the gun pole piece in the electron gun region of a traveling-wave tube constructed with the aforementioned periodic permanent magnet focusing arrangement;

FIG. 3*c* is a graph illustrating the normally observed overall axial magnetic field in the electron gun region of a traveling-wave tube constructed with the aforementioned periodic permanent magnet focusing arrangement;

FIG. 5 is a graph illustrating the electron beam radius as a function of axial distance along the aforementioned traveling-wave tube constructed according to FIGS. 1 and 2.

DETAILED DESCRIPTION OF THE INVENTION

Figure 1:
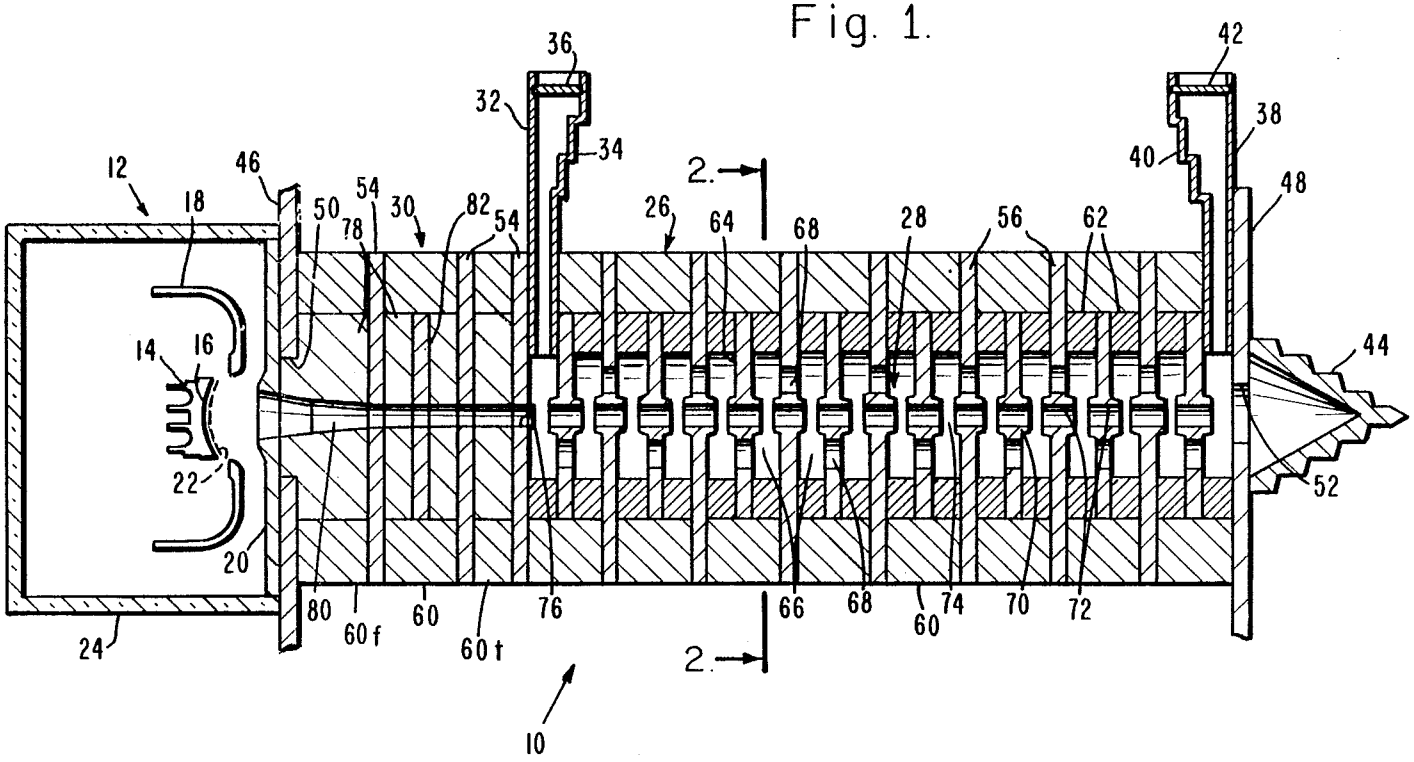
FIG. 1 is a longitudinal sectional view illustrating a traveling-wave tube incorporating a confined-flow periodic permanent magnet focusing arrangement in accordance with the present invention.

Referring to the drawings with more particularity, and especially to FIG. 1, there is shown a traveling-wave tube 10 incorporating a confined-flow periodic permanent magnet focusing arrangement according to the invention. An electron gun 12 is provided at one end of the traveling-wave tube 10 for generating a stream of electrons and projecting it along an axial path through the tube 10. The electron gun 12 includes a cathode 14 having a concave electron emissive surface 16, an annular focusing electrode 18 disposed downstream from the cathode 14, and an apertured plate-like anode 20 disposed further downstream from the cathode 14. In the specific exemplary embodiment illustrated in FIG. 1, a control grid 22 is disposed adjacent to the cathode emissive surface 16 for starting and stopping the emission or an electron stream from the surface 16. It should be understood, however, that a confined-flow focusing arrangement according to the invention may be used in traveling-wave tubes having both gridded and non-gridded electron guns. The various electrodes 14, 18, 20, and 22 are disposed within a suitable electron gun housing 24 which typically may be of ceramic material.

Disposed about the electron stream path downstream from the electron gun 12 is a confined-flow periodic permanent magnet focusing arrangement 26 for providing an axial magnetic field which focuses the stream electrons into a well-collimated beam along the axis of arrangement 26. Disposed within at least a portion of the focusing arrangement 26 is a slow-wave structure 28 which propagates electromagnetic wave energy along the electron stream path with a phase velocity substantially less than the velocity of light so that the electromagnetic wave energy can interact with the stream electrons. In the specific exemplary traveling-wave tube 10 illustrated in FIG. 1, the slow-wa e structure 28 does not extend over the entire length of the focusing arrangement 26, but rather the arrangement 26 has a beam scraper portion 30, formed from solid copper pieces 78 with a beam hole 80 extending therethrough, which is disposed between the upstream end of the slow-wave structure 28 and the electron gun 12 for intercepting stream electrons during the starting and stopping of the electron stream by the grid 22 for protecting the RF circuit structure from gross beam defocusing that may occur because of incorrect cathode voltage, arcing, etc. It is pointed out, however, that the beam scraper portion 30 could be eliminated and the slow-wave structure 28 could extend throughout the entire length of the focusing arrangement 26.

In order to apply input electromagnetic waves to be amplified to the slow-wave structure 28, an input waveguide 32 is coupled to the upstream end of the slow-wave structure 28. The waveguide 32 may include a stepped impedance-transforming section 34 as well as a window element 36 transparent to electromagnetic wave energy but enabling the interior of the traveling-wave tube 10 to be maintained at a vacuum pressure. Similarly, in order to remove amplified electromagnetic waves from the traveling-wave rube 10, an output waveguide 38 is coupled to the downstream end of the slow-wave structure 28. The output waveguide 38 also may include a stepped impedance-transforming section 40 and a vacuum window 42. In order to collect stream electrons after they have traveled through the slow-wave structure 28, a collector electrode 44 is provided at the downstream end of the slow-wave structure 28.

The magnetic focusing arrangement 26 includes a disk-like gun pole piece 46 of ferromagnetic material, such as a vacuum-melted high-purity iron, for example, disposed along the electron stream path immediately downstream from the electron gun 12 and a similar disk-like collector pole piece 48 disposed along the electron stream path immediately upstream from the collector 44. As shown in FIG. 1, the gun pole piece 46 abuts the anode 20, while the collector pole piece 48 abuts the collector 44. The pole pieces 46 and 48 are provided with respective coaxially aligned central apertures 50 and 52 to allow stream electrons to pass therethrough. A plurality of intermediate disk-like ferromagnetic pole pieces including beam scraper pole pieces 54 and slow-wave structure pole pieces 56 are disposed at respective spaced locations along the electron stream path between the gun pole piece 46 and the collector pole piece 48. The pole pieces 54 and 56 are provided with respective coaxially aligned apertures in their central regions, discussed in more detail below, to provide a passage for the flow cf the electron stream.

The focusing arrangement 26 also includes a series of permanent magnets respectively interposed between and abutting adjacent pairs of the pole pieces 46, 54, 56, and 48. The magnets 60, which may be of samarium cobalt, for example, are arranged along the axis of the traveling-wave tube 10 with like poles of adjacent magnets confronting one another so that a magnetic field reversal occurs at each pole piece (except for the gun pole piece 46 as will be discussed in more detail below). As shown in FIGS. 1 and 2, the magnets 60 may be annular magnets coaxially disposed about the electron stream path. However, it is pointed out that alternatively other shapes and arrangements of permanent magnets may be used such as the four-magnet array disclosed and claimed in U.S. Pat. No. 4,668,893 to Kurt Amboss, entitled "Magnetic Circuit for Periodic-Permanent-Magnet Focused TWTs" and assigned to the assignee of the present invention.

The pole pieces 54 and 56 extend radially inwardly of the magnets 60 to approximately the perimeter of the region adapted to contain the electron stream flowing along the axis of the tube 10. In order to form the slow-wave structure 28, interaction cavity defining spacer elements 62 are disposed radially within magnets 60 in the region containing the slow-wave structure 28. In the specific exemplary arrangement shown in FIG. 1 wherein regions of minimum axial magnetic field are provided between the regions of magnetic field reversal which occur at respective pole pieces 56, a pair of coaxially aligned annular spacer elements 62 are disposed within each magnet 60 in the slow-wave structure region. The spacer elements 62 each have an outer diameter essentially equal to the inner diameter of the magnets 60 and are laterally spaced along the inner circumferential surface of magnets 60. A plate-like member 64 of ferromagnetic material is disposed between each pair of spacer elements 62 disposed within a particular magnet 60 and extends from the inner circumferential surface of the magnet 60 to approximately the perimeter of the electron stream region. The spacer elements 62, plate-like members 64, and pole pieces 56 thus define a series of interaction cavities 66 along the axis of the slow-wave structure 28. The radial extent of each interaction cavity 66 is determined by the inner diameter of spacer element 62, while the axial length of each cavity 66 is determined by the distance between the pole piece 56 and the plate-like member 64 defining the respective ends of the cavity 66.

For interconnecting adjacent interaction cavities 66 an off-center coupling hole 68 is provided through each pole piece 56 and each plate-like member 64 to permit the transfer of electromagnetic wave energy from cavity to cavity. As illustrated in FIGS. 1 and 2, the coupling hole 68 may be substantially kidney shaped and may be alternately disposed 180° apart with respect to the axis of the slow-wave structure 28, although it should be understood that coupling holes of other shapes and staggered in various other arrangements may be employed.

Each pole piece 56 and each plate-like member 64 is constructed such that a short drift tube, or ferrule, 70 is provided at its inner radial extremity. The drift tube 70 is in the form of a cylindrical extension, or lip, protruding axially along the path of the electron stream from both broad surfaces of the pole piece 56 or the plate-like member 64 on which it is formed. The drift tubes 70 are provided with central and axially aligned apertures 72 to provide a passage for the flow of the electron stream. Adjacent ones of the drift tubes 70 are separated by a gap 74 in which energy exchange occurs between the electron stream and the electromagnetic waves traversing the slow-wave structure 28.

In the beam scraper portion 30 of the focusing arrangement 26, the pole pieces 54 define respective apertures 76 in their central regions which are aligned with the drift tube apertures 72. Coaxially disposed radially within the magnets 60 in the beam scraper portion 30 are respective massive or solid cylindrical members 78 defining respective central apertures 80 aligned with the pole piece aperture 76 to provide a passage for the electron stream. The massive members 78, which intercept stream electron current surges during the starting and stopping of the electron stream, should be of a material of high thermal conductivity such as copper to enhance the removal of heat generated by electron interception. If desired, as shown in FIG. 1, an axial magnetic field minimum may be provided within the middle magnet of the beam scraper portion 30 (in a manner similar to that providing the intermediate axial magnetic field minima between pole pieces in the slow-wave circuit 28) by disposing a ferromagnetic plate-like member 82 axially midway within the middle magnet 60 and which extends from the inner circumferential surface of the middle magnet 60 to the perimeter of the electron stream.

As was mentioned above, in a conventional periodic permanent magnet focusing arrangement wherein the magnets all have substantially the same axial extent, the axial magnetic field leaking through the gun pole piece aperture 50 into the electron gun 12 experiences a polarity reversal in a region generally between the anode 20 and the cathode 14. This polarity reversal is due to the fact that the axial magnetic field within the electron gun consists of two components, one produced by the magnetic field leaking through the gun pole piece aperture 50 and the other produced by the magnetic potential on the gun pole piece 46. The axial magnetic field component leaking through the gun pole piece aperture 50 is shown by curve 84 of FIG. 3a. In FIG. 3a, $Z_c$ depicts the axial location of the cathode, while $Z_g$ shows the axial location of the center of the gun pole piece. It may be seen from curve 84 that the leakage magnetic field decreases monotonically as a function of distance into the electron gun from the gun pole piece, the decrease being relatively rapid adjacent to the pole piece and relatively slow in the vicinity of the cathode.

The axial magnetic field component in the electron gun due to the magnetic potential acquired by the gun pole piece is illustrated by curve 85 of FIG. 3b. It may be seen that, while the pole piece field also decreases in magnitude as a function of distance into the electron gun from the gun pole piece, this field is of opposite polarity to the leakage field. The overall axial magnetic field in the electron gun, which is the algebraic sum of the leakage field of curve 84 and the pole piece field of curve 85, is illustrated by curve 86 of FIG. 3c. It may be seen from curve 86 that in the region adjacent to the gun pole piece the overall magnetic field is dominated by the leakage field as shown by curve portion 87. However, as the distance from the gun pole piece increases, a point 88 is reached at which the magnitude of the leakage field is equal to that of the pole piece field, and these field components cancel one another due to their opposite polarity. In the vicinity of the cathode the pole piece field dominates, producing an overall magnetic field shown by curve portion 89 which is of opposite polarity to that shown by curve portion 87. The reversal of the polarity of the magnetic field at point 88 gives rise to an outward magnetic force on electrons emitted from the cathode and therefore reduces the beam convergence produced electrostatically by the electron gun in the vicinity of the field reversal.

In accordance with the present invention, a scalar magnetic potential of essentially zero is provided on the gun pole piece 46. As a result, the gun pole piece 46 makes no contribution to the magnetic field within the electron gun 12, and a magnetic field is provided in the region of the electron gun 12 between the gun pole piece 46 and a location behind the cathode 14 which is due solely to the magnetic field leaking through the gun pole piece aperture 50.

It can be demonstrated from physical principles that the magnetic potential on the gun pole piece 46, and hence the magnetic field produced by the pole piece 46, can be made zero by selecting the line integral of the quantity $\vec{H}\cdot\vec{dl}$ from the midplane of a symmetrical stack of permanent magnets and slow-wave circuit pole pieces to the gun pole piece on a path through the magnets and pole pieces equal to zero, where $\vec{H}$ is the magnetic field of the magnets and $\vec{dl}$ is a short segment of path length in the direction of the magnetic field.

In a preferred embodiment of the invention, essentially zero magnetic potential can be provided on the gun pole piece 46 by constructing either the first magnet 60f or the third magnet 60t, that is, a magnet which is positioned in an odd-numbered sequence, from the gun pole piece 46 to have with an axial extent approximately one-half that of the remaining magnets 60 in the focusing arrangement 26. Preferably, as illustrated in FIG. 1, the third magnet 60t is made with half the axial extent of the others, since such an arrangement affords an axial magnetic field in the electron gun region which more closely resembles that achievable with a solenoid. The present invention further applies the technique used in solenoid focusing to a periodic permanent magnet (PPM) focusing arrangement in the novel manner of tailoring or fine tuning the axial magnetic field within the electron gun 12 by varying the size of the aperture 50 in the gun pole piece 46.

Figure 4:
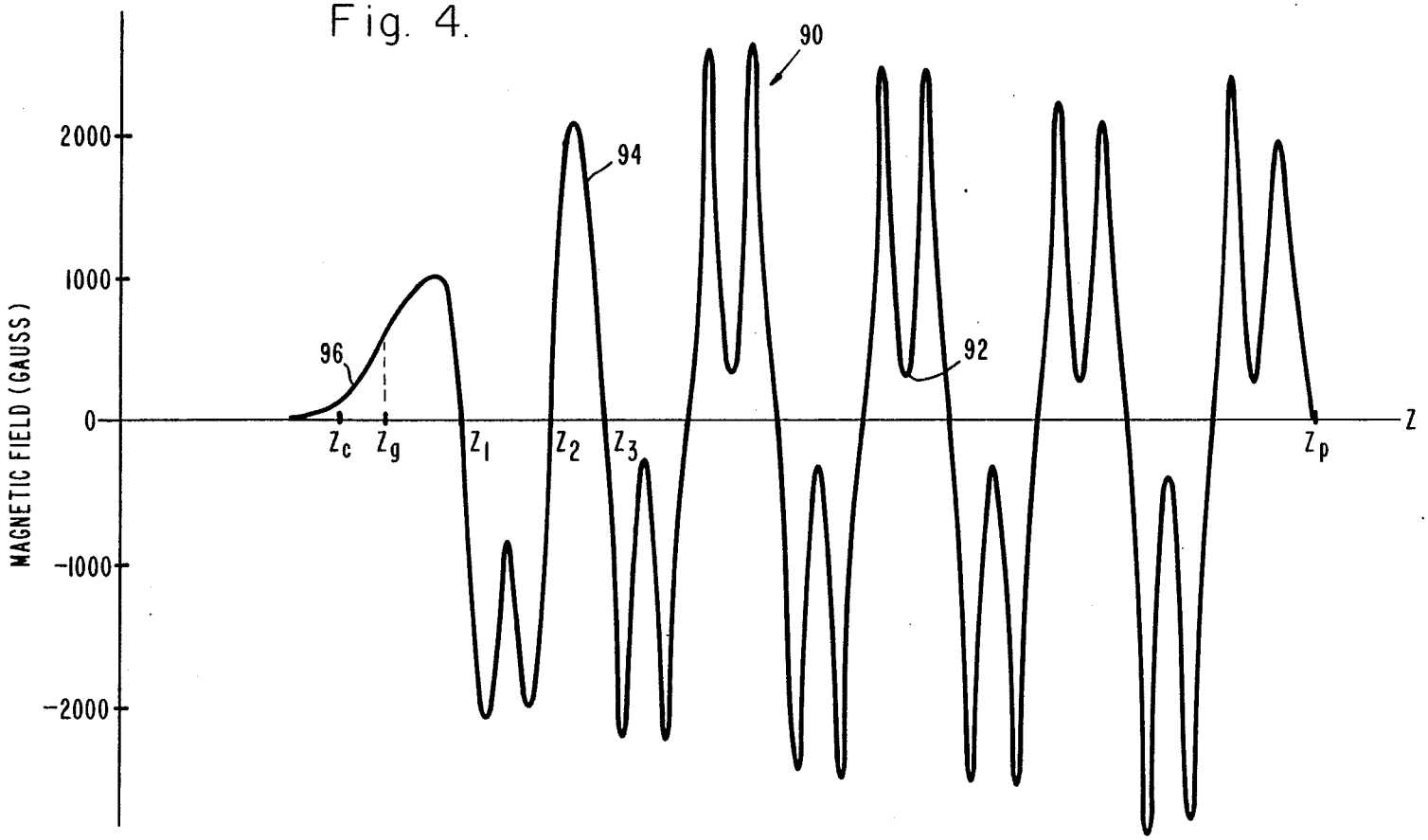
FIG. 4 is a graph showing the magnetic field at the axis of a traveling-wave tube constructed according to FIGS. 1 and 2 as a function of axial distance along the tube.

In FIG. 4 curve 90 depicts a typical axial magnetic field for a traveling-wave tube 10 constructed according to FIGS. 1 and 2 as a function of axial distance Z along the tube 10. It may be seen that a periodically varying magnetic field distribution is produced along the axis of the tube, with zero magnetic field occurring at the center of each pole piece 54 or 56 and with intermediate magnetic field minima 92 at respective regions where the planes of the plate-like members 64 and 82 intersect the tube axis. In FIG. 4 $Z_c$ depicts the axial location of the cathode 14, $Z_g$ depicts the axial location of the gun pole piece 46, $Z_p$ represents the axial location of the collector pole piece 48, and $Z_1$, $Z_2$ and $Z_3$ represent the respective axial locations of the first, second, and third pole pieces 54 from the gun pole piece 46. Curve portion 94 shows the axial magnetic field provided by the half-extent magnet 60*t*, while curve portion 96 illustrates the axial magnetic field within the electron gun 12, thus demonstrating the elimination of the field reversal, as illustrated by curve portion 89 of FIG. 3(*c*).

In FIG. 5 curve 100 illustrates the electron beam radius as a function of axial distance Z along a typical traveling-wave tube 10 constructed according to FIGS. 1 and 2. It may be seen from curve 100 that even with the presence of half-extent magnet 60*t* between pole piece locations $Z_2$ and $Z_3$ a well-collimated beam of substantially constant radius is provided along the arrangement 26 between the pole piece locations $Z_1$ and $Z_p$.

Figure 6:
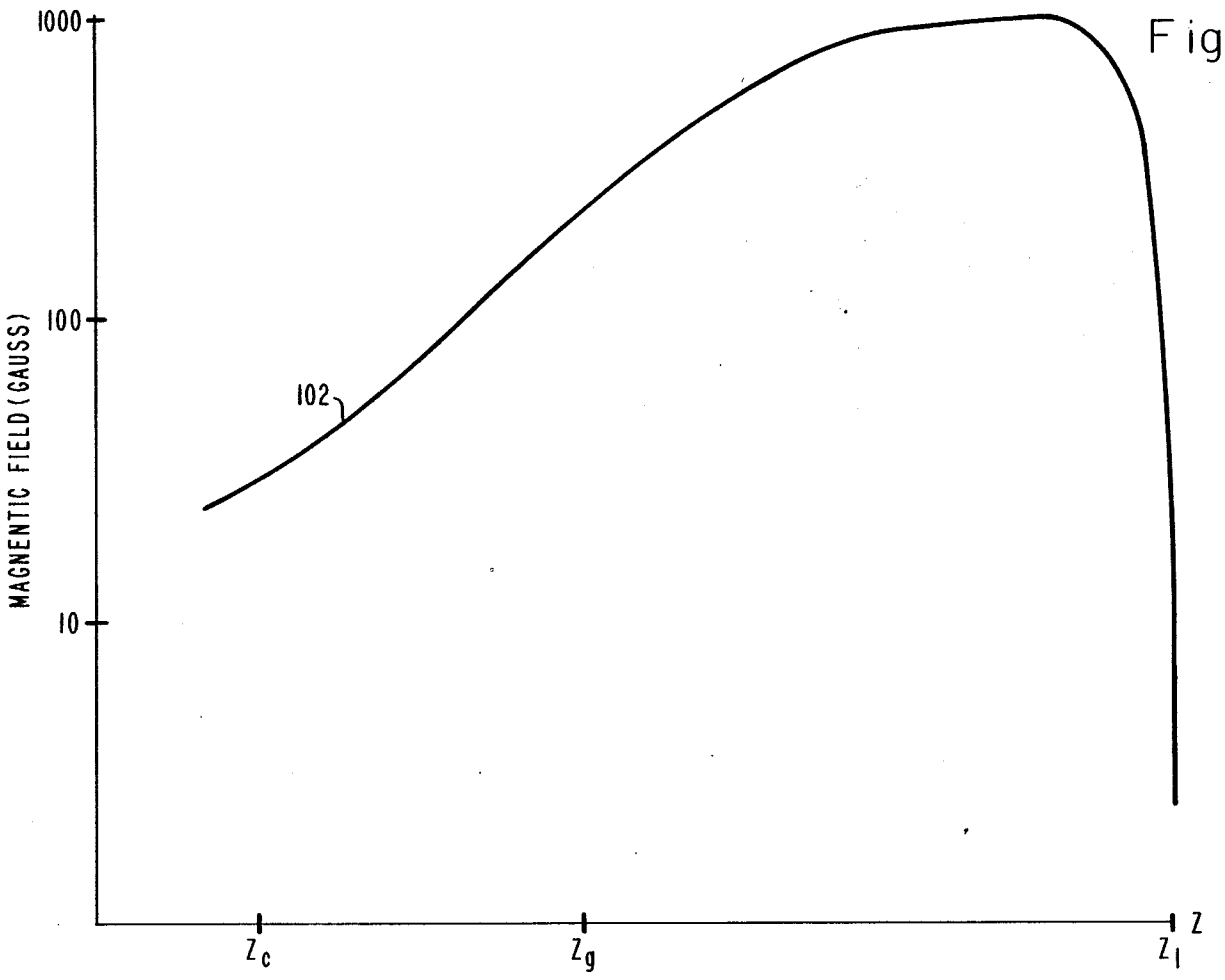
FIG. 6 is a semilogarithmic graph illustrating the magnetic field as a function of axial distance in the cathode region of the aforementioned traveling-wave tube constructed according to FIGS. 1 and 2, as well as in an otherwise comparable traveling-wave tube without a confined-flow focusing arrangement according to the invention.

In FIG. 6 curve 102 illustrates the axial magnetic field as a function of axial distance Z in the region between the location $Z_1$ of the first pole piece 54 and a location just behind the cathode 14 in a typical traveling-wave tube 10 constructed according to FIGS. 1 and 2. It may be seen from FIG. 6 that the present invention enables a substantial axial magnetic field to be provided at the cathode location $Z_c$ without a field reversal.

The substantial axial magnetic field in the vicinity of the cathode 14 is achieved without any degradation of the beam convergence of the electron gun and without having any permanent magnet disposed about the electron gun 14. Thus, stray magnetic fields outside of the electron gun region are substantially reduced, and any tendency for arcing in the vicinity of the electron gun 14 is minimized. Moreover, a compact, simple, and reliable confined-flow periodic permanent magnet focusing arrangement 26 is provided, and the magnetic field in the electron gun region can be readily and safely adjusted simply by adjusting the size of the gun pole piece aperture 50.

Although the present invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. In a traveling-wave tube focusing structure having an electron gun cathode, collector means, first and second ferromagnetic pole pieces respectively positioned adjacent to the cathode and to the collector means, and a series of permanent magnets positioned between the pole pieces, the improvement in eliminating field reversal at the cathode, in which:

one of the magnets, which is positioned in an odd-numbered sequence immediately located adjacent from the first pole piece, has an axial thickness which is different from an axial thickness associated with the remainder of the magnets for providing a scalar magnetic potential of essentially zero on the first pole piece, thereby eliminating the field reversal at the cathode.

2. A traveling-wave tube according to claim 1 wherein said one of said magnets consists of a first or a third one of said series magnets located adjacent from said first pole piece and has an axial thickness of approximately one-half of said thickness associated with the remaining magnets.

3. A traveling-wave tube according to claim 2 wherein said one of said magnets is said third one of said magnets.

4. An improvement according to claim 1 further including electron gun means incorporating the cathode, wherein the first pole piece has an aperture which is sized to tailor the axial magnetic field within the electron gun means.

5. A traveling-wave tube comprising:

electron gun means including a cathode for generating a stream of electrons along a predetermined axial path;

collector means disposed at an end of said path remote from said electron gun means for collecting electrons of said stream;

a disk-like ferromagnetic gun pole piece disposed along said path adjacent to said electron gun means, a disk-like ferromagnetic collector pole piece disposed along said path adjacent to said collector means, and a plurality of intermediate disk-like ferromagnetic pole pieces disposed at respective spaced locations along said path between said gun and collector pole pieces, said gun, collector and intermediate pole pieces having respective aligned apertures in their central regions and along said path to provide a passage for said stream of electrons;

a series of permanent magnets respectively interposed between and abutting ones of said pole pieces with like poles of adjacent magnets confronting one another, a first or a third one of said magnets located adjacent from said gun pole piece having an extent along said axial path which is approximately one-half of an extent along said axial path which is associated with the remaining magnets in said series for providing a scalar magnetic potential of essentially zero on said gun pole piece, thereby eliminating any field reversal otherwise arising at said cathode;

said pole pieces projecting radially inwardly of said magnets, at least certain successive ones of said pole pieces located adjacent from said gun pole piece each defining a coupling hole in a region radially outwardly of respective said aligned apertures, and means disposed radially inwardly of each of said magnets adjacent to at least one of said certain pole pieces for providing a plurality of interaction cavities therebetween, said interaction cavities being of substantially equal axial extent and being successively disposed along said axial path, whereby electromagnetic wave energy may propagate through said coupling holes in said certain pole pieces.

6. A traveling-wave tube according to claim 5, in which the aperture in said gun pole piece is sized for tailoring the electron gun means axial magnetic field, thereby for providing confined-flow focusing to the cathode.

7. A traveling-wave tube according to claim 5 wherein said on magnet is the third one of said magnets from said gun pole piece.

8. A traveling-wave tube according to claim 7 wherein said means for providing a plurality of interaction cavities is disposed radially within a portion of said series of magnets between said third one of said magnets and said collector pole piece.

9. A traveling-wave tube according to claim 5 wherein said means for providing a plurality of interaction cavities is disposed radially within a portion of said series of magnets extending substantially from a fourth one of said magnets to the end of said series adjacent to said collector pole piece.

10. A traveling-wave tube according to claim 9 wherein said electron gun means includes a grid for starting and stopping said stream of electrons, and beam scraper means are provided within at least a portion of each of a first, a second and said third one of said magnets from said gun pole piece for intercepting electrons of said stream during the starting and stopping of said stream.

11. A traveling-wave tube according to claim 10 wherein said beam scraper means includes substantially solid cylindrical members of a material of good thermal conductivity respectively disposed radially within a first, a second and said third one of said magnets and having respective apertures therethrough along said axial path aligned with said apertures of said pole pieces.

12. A traveling-wave tube according to claim 5 wherein said means for providing a plurality of interaction cavities includes a plurality of annular members of electrically conductive nonmagnetic material and a plate-like member of ferromagnetic material interposed between and abutting each pair of adjacent annular members, each said plate-like member extending radially inwardly from the adjacent annular member to the vicinity of said axial path, each said plate-like member defining an aperture in a central region which is aligned with said aligned apertures of said pole pieces to provide a passage for said stream of electrons, each said plate-like member further defining a coupling hole in a region radially outwardly of said central region for interconnecting adjacent interaction cavities, whereby electromagnetic wave energy may propagate through said coupling holes in said plate-like members and in said certain pole pieces.

13. In a traveling-wave tube including (a) electron gun means having a cathode for generating a stream of electrons along a predetermined axial path, (b) collector means disposed at an end of said path remote from said electron gun means for collecting electrons of said stream, (c) a gun ferromagnetic pole piece disposed along said path adjacent to said electron gun means, a collector ferromagnetic pole piece disposed along said path adjacent to said collector means, and a plurality of intermediate ferromagnetic pole pieces disposed at respective spaced locations along said path between said gun and collector pole pieces, said gun, collector and intermediate pole pieces having respective aligned apertures along said path to provide a passage for said stream of electrons, (d) a series of permanent magnets respectively interposed between and abutting adjacent ones of said pole pieces with like poles of adjacent magnets confronting one another, and (e) slow-wave structure means disposed along and surrounding said path and adjacent to at least a portion of said series of magnets for propagating electromagnetic wave energy in such manner that said electromagnetic wave energy can interact with said stream of electrons, the improvement in eliminating field reversal at the cathode, in which:

a first or a third one of said magnets located adjacent from said gun pole piece has an axial thickness which is different from an axial thickness associated with the remainder of said magnets for providing a scalar magnetic potential of essentially zero on said gun pole piece, thereby eliminating the field reversal at the cathode.

14. A traveling-wave tube according to claim 13 wherein said slow-wave structure means is disposed adjacent to a portion of said series of magnets between said third one of said magnets and said collector pole piece.

15. A traveling-wave tube according to claim 13 wherein said slow-wave structure means is disposed adjacent to a portion of said series of magnets extending substantially from a fourth one of said magnets to the end of said series adjacent to said collector pole piece.

16. A traveling-wave tube according to claim 13 in which the aperture in said gun pole piece is sized for tailoring the electron gun means axial magnetic field, thereby for providing confined-flow focusing to the cathode.

17. In a traveling-wave tube focusing structure having an electron gun cathode, collector means, first and second ferromagnetic pole pieces respectively positioned adjacent to the cathode and to the collector means, and a series of permanent magnets positioned between the pole pieces, a method for eliminating field reversal, comprising the steps of:

positioning one of said magnets having a predetermined shape in an odd-numbered sequence immediately adjacent to the first pole piece, with respect to that of the remainder of the magnets for providing a scalar magnetic potential of essentially zero on the first pole piece, thereby eliminating the field reversal at the cathode.

18. A method according to claim 17 in which the traveling-wave tube further includes electron gun means incorporating the cathode, and the first pole piece has an aperture, further comprising the step of sizing the aperture to tailor the axial magnetic field within the electron gun means.

* * * * *